US009695990B2

(12) United States Patent
Gassner et al.

(10) Patent No.: US 9,695,990 B2
(45) Date of Patent: Jul. 4, 2017

(54) ARRANGEMENT FOR LIGHT EMISSION

(75) Inventors: Patrick Gassner, St. Gerold (AT); Michael Spiegel, Dornbirn (AT)

(73) Assignee: Zumtobel Lighting GmbH, Dornbirn (AT)

( * ) Notice: Subject to any disclaimer, the term of this patent is extended or adjusted under 35 U.S.C. 154(b) by 149 days.

(21) Appl. No.: 13/825,238

(22) PCT Filed: Sep. 26, 2011

(86) PCT No.: PCT/EP2011/066634

§ 371 (c)(1),
(2), (4) Date: May 7, 2013

(87) PCT Pub. No.: WO2012/041794

PCT Pub. Date: Apr. 5, 2012

(65) Prior Publication Data

US 2014/0104825 A1 Apr. 17, 2014

(30) Foreign Application Priority Data

Sep. 27, 2010 (DE) ..... 10 2010 041 477

(51) Int. Cl.

| | |
|---|---|
| ***F21S 4/00*** | (2016.01) |
| ***F21V 1/00*** | (2006.01) |
| ***F21V 11/00*** | (2015.01) |
| ***F21V 3/00*** | (2015.01) |
| ***F21V 5/00*** | (2015.01) |
| ***F21K 99/00*** | (2016.01) |
| ***F21K 9/00*** | (2016.01) |

(Continued)

(52) U.S. Cl.

CPC ..... *F21K 9/17* (2013.01); *F21K 9/00* (2013.01); *F21K 9/27* (2016.08); *F21S 8/04* (2013.01); *F21V 5/00* (2013.01)

(58) Field of Classification Search

CPC ..... F21V 7/005; F21V 13/04; F21V 19/0035; F21V 19/004; F21V 7/0008; F21V 7/06; F21V 5/00; F21S 8/04

USPC ..... 362/223, 235, 245, 217.02, 217.05, 362/217.06, 217.07, 217.1, 249.02, 307, 362/308, 246.08, 311.02

See application file for complete search history.

(56) References Cited

U.S. PATENT DOCUMENTS 6,361,186 B1 3/2002 Slayden
6,739,734 B1 * 5/2004 Hulgan ..... 362/243
(Continued)

FOREIGN PATENT DOCUMENTS

KR WO 2010024583 A2 * 3/2010 ..... F21K 9/13

OTHER PUBLICATIONS

International Search Report issued in connection with the corresponding International Application No. PCT/EP2011/066634 on Dec. 6, 2011.

*Primary Examiner* — Renee Chavez
*Assistant Examiner* — Erin Kryukova
(74) *Attorney, Agent, or Firm* — The H.T. Than Law Group

(57) ABSTRACT

An arrangement for light emission has at least one LED light-emitting means (110) in an elongate arrangement, a support element (120), which supports the LED light-emitting means (110) and a light emission element (130) which can be connected to the support element (120). The light emission element (130) is designed to modify the light emission characteristic of the LED light-emitting means (110) to give the light emission characteristic of at least one fluorescent tube.

7 Claims, 3 Drawing Sheets

(51) Int. Cl.
*F21S 8/04* (2006.01)
*F21K 9/27* (2016.01)

(56) References Cited

U.S. PATENT DOCUMENTS

| | | | | |
|---|---|---|---|---|
| 6,851,834 | B2 * | 2/2005 | Leysath | 362/303 |
| 7,192,161 | B1 | 3/2007 | Cleaver et al. | |
| 2003/0117798 | A1 * | 6/2003 | Leysath | F21S 8/04 362/248 |
| 2006/0028837 | A1 | 2/2006 | Mrakovich | |
| 2007/0285922 | A1 * | 12/2007 | Chen | 362/240 |
| 2008/0007945 | A1 * | 1/2008 | Kelly | A47F 3/001 362/218 |
| 2008/0080189 | A1 * | 4/2008 | Wang | 362/294 |
| 2008/0086922 | A1 | 4/2008 | Chen et al. | |
| 2009/0046457 | A1 * | 2/2009 | Everhart | F21V 23/009 362/235 |
| 2010/0110679 | A1 * | 5/2010 | Teng | F21K 9/00 362/235 |
| 2010/0124064 | A1 * | 5/2010 | Ogawa et al. | 362/307 |
| 2010/0157596 | A1 * | 6/2010 | Wen | B60Q 3/06 362/235 |
| 2010/0296281 | A1 * | 11/2010 | Hofmann | 362/235 |
| 2011/0286214 | A1 * | 11/2011 | Quinlan et al. | 362/235 |
| 2011/0297971 | A1 * | 12/2011 | Shimizu | F21S 8/04 257/88 |
| 2012/0033420 | A1 * | 2/2012 | Kim | F21V 3/0427 362/235 |
| 2013/0033859 | A1 * | 2/2013 | Yaphe | F21V 5/007 362/223 |

* cited by examiner

ARRANGEMENT FOR LIGHT EMISSION

The subject matter of the application is an arrangement for light-emission having LED illuminants in an elongate arrangement, a carrier element which carries the LED illuminants, and a light-radiating element which can be connected to the carrier element. Further subject matter of the application is a luminaire.

BACKGROUND OF THE INVENTION

The optical capacity of LED light sources has undergone a development, making their use appear of interest for general lighting purposes. LED light sources are distinguished by their efficiency and, whilst provided the operating conditions are observed, by particular reliability. Their light-radiation characteristic as well as the operating conditions to be observed do, however, basically differ from those of conventional illuminants, such as, for example, incandescent bulbs, fluorescent tubes or gas-discharge lamps, so that it appears that existing luminaire constructions can only be retrofitted at considerable expense.

SUMMARY OF THE INVENTION

An object of the present invention is to provide an arrangement for light-emission which optimizes the outlay on retrofitting existing luminaire constructions.

This object is achieved with the features of the independent claims. Further developments of the invention constitute subject matter of the dependent claims. An arrangement for light-emission in accordance with the invention has at least one LED illuminant in an elongate arrangement, a carrier element which carries the LED illuminant, and a light-radiating element which can be connected to the carrier element. The light-radiating element is formed to convert the light-radiation characteristic of the LED illuminant to the light-radiation characteristic of at least one fluorescent tube. Simple replacement of conventional fluorescent tubes by LEDs is thus possible without having to effect a complete new construction.

Basing considerations on the thought that the light-radiation characteristic and the position of installation of LEDs and conventional light sources differ for reasons of observance of the operating conditions for the respective illuminants, an arrangement is proposed for light-emission that has LED illuminants in an elongate arrangement, a carrier element which carries the LED illuminants, and a light-radiating element which can be connected to the carrier element.

It is provided in this connection that the light-radiating element radiates incident radiation of the LED illuminants over a light-emission area so that adaptation of the light-radiation characteristic can be carried out by way of the form of the light-radiating element. An elongate arrangement of the LED illuminants assists the approximation to the light-radiation characteristic of a fluorescent tube. A plurality of LEDs that admittedly preferably belong to the same type class can be used as illuminants, although the invention is not limited thereto in the least. For example, LEDs with different power characteristics or colour radiation can be used.

The light-radiating element is preferably formed to simulate the light-radiation characteristic of an arrangement of fluorescent tubes. In a further development of the invention it is provided that the light-radiating element is formed as a diffuser. This renders possible, starting from the surface, uniform illumination of larger areas.

Simulation of the light-radiation characteristic of an arrangement of a plurality of fluorescent tubes is also possible. Typically, the close arrangement of two fluorescent tubes side by side is replaced thus.

BRIEF DESCRIPTION OF THE DRAWINGS

The invention is described by way of example in the following with reference to the drawings in which an advantageous exemplary embodiment of the invention is presented and in which.

DETAILED DESCRIPTION OF THE INVENTION

In the first instance, the general structure of the luminaire in accordance with the invention is explained with reference to FIG. 1. Subsequently, the precise technical structure and the mode of functioning of the luminaire in accordance with the invention and the arrangement for light-emission in accordance with the invention are presented with reference to FIG. 2. Identical elements have in part not been repeatedly presented and described in figures that are similar.

Figure 1:
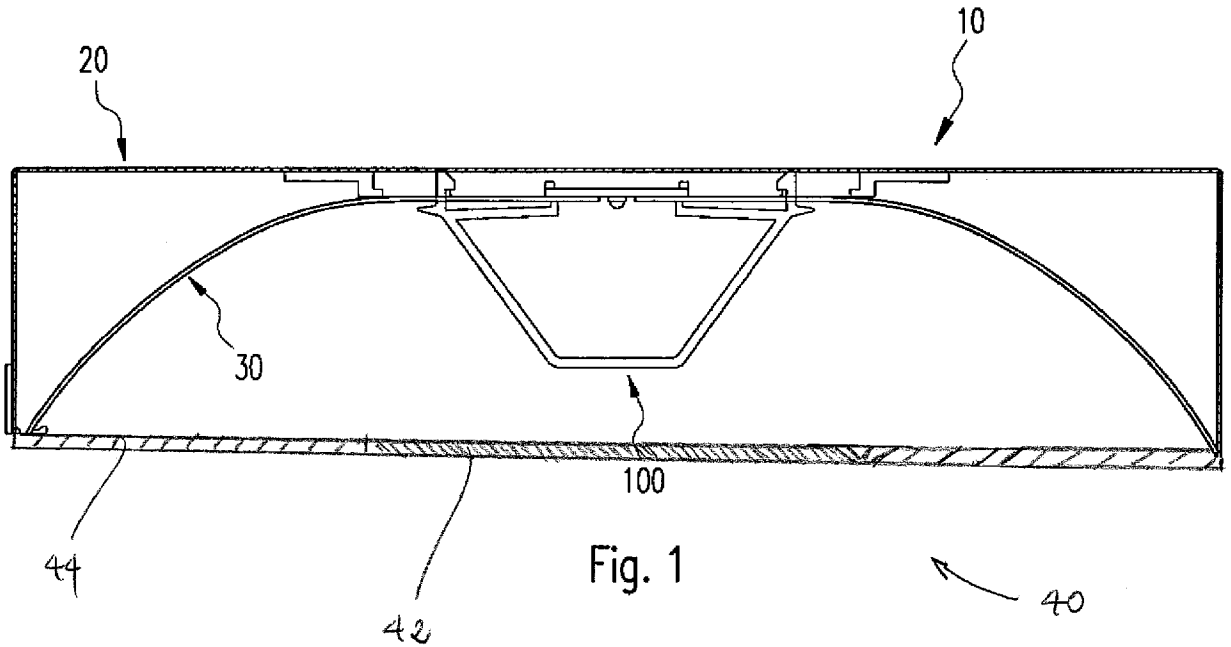
FIG. 1 shows an exemplary embodiment of the arrangement in accordance with the invention and FIG. 3 shows the embodiment of FIG. 1 as an elongate arrangement.

FIG. 1 shows an exemplary embodiment of a luminaire 10 in accordance with the invention in a sectional representation. The luminaire 10 in accordance with the invention in this case contains a housing 20, a reflector 30 and an arrangement for light-emission 100. With its closed side, the upper side in the drawing, the housing 20 can in this case be secured to a surface, for example a ceiling. The light-emission is effected through the arrangement for light-emission 100 in the opposite direction. The reflector 30 then reflects a portion of the luminous power emitted by the arrangement for light-emission 100.

The reflector 30 is in this case set up with a curved form, in particular a parabolic form. Uniform illumination of a region that is controllable in a targeted manner is thus achieved. The reflector 30 in this case ends so as to be flush with the housing 20 of the luminaire 10. The reflector 30 is provided with a focal point in the sectional representation. In three-dimensional reality, this is not a focal point, but a focal line. The focal point or line largely corresponds, at least in sections 165, with the outer surface of the light-radiating element 130, or rather sections 165 of the limiting face or outer surface 160 of the light-radiating element 130 correspond with the focal point or line. Optimum distribution of the light that is radiated by the light-radiating element 130 through the reflector 30 is thus achieved.

Figure 2:
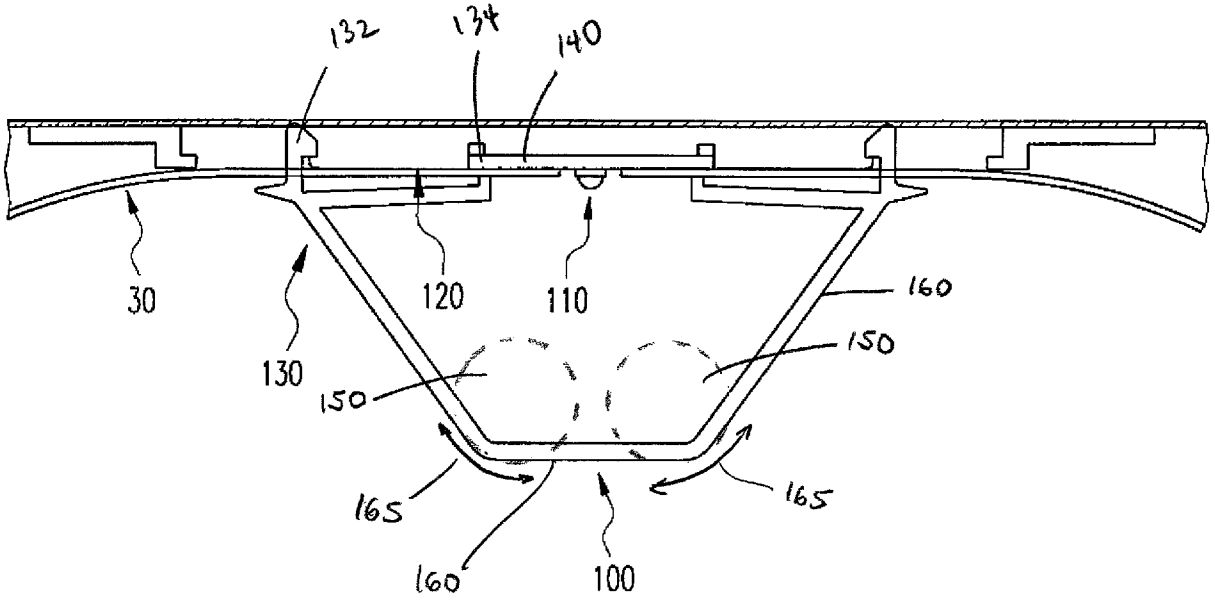
FIG. 2 shows a detailed view of the exemplary embodiment of the arrangement in accordance with the invention.
Figure 3:
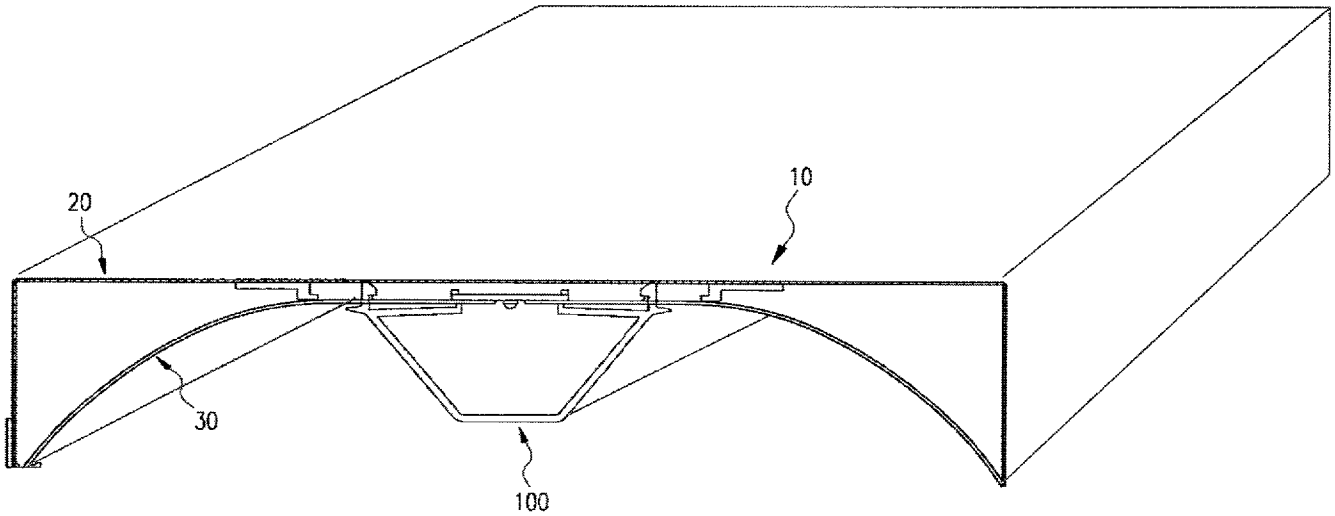

The arrangement for light-emission 100, which is shown in greater detail in FIG. 2, contains a carrier element 120, an LED illuminant 110 and a light-radiating element 130. The carrier element 120 is reversibly connectable to an illuminant-carrier, in that the illuminant-carrier is an LED printed circuit board 140 shown in FIG. 2, and in that the carrier element 120 and the illuminant-carrier are preferably connectable and releasable without a tool. The carrier element 120 is in this case connected to the housing 20 of the luminaire 10. The carrier element 120 carries, furthermore, the LED illuminant 110. Alternatively, a plurality of LED illuminants 110 can also be secured to the carrier element 120. The LED illuminant 110 is preferably reversibly connected to the carrier element 120 and can be connected or separated without the use of a tool. The LED illuminant 110 is arranged in such a way that the light-radiation is effected in the direction of the open side of the housing. Arranged between the LED illuminant 110 and the open side of the housing there is, furthermore, the light-radiating element 130. In this case, light-radiating element 130 is connected to the carrier element 120 and held by it at connections 132 and 134. Advantageously, this connection is reversible and can be effected and released without the use of a tool. Instead of being connected merely to the housing 20, the carrier element 120 can complete the surface of the housing 20 that is interrupted by an opening. It is thus possible to make savings in terms of material for the housing.

The reflector 30 is likewise connected to the carrier element 120. In the case of a conventional luminaire, one or more fluorescent tubes would be located at the focal point or focal line of the reflector 30 along sections 165, when more than one fluorescent tubes are present. These would be arranged perpendicularly with respect to the sectional plane of the drawings. The light-radiating element 130 is formed here in such a way that its outer form largely corresponds to the contour of the fluorescent tube or fluorescent tubes in a conventional luminaire. The light-radiating element 130 thus converts the light-radiation characteristic of the LED illuminant 110 to the light-radiation characteristic of at least one fluorescent tube.

For this, the light-radiating element 130 is formed as a diffuser. In other words, hard light is turned into soft diffused light. Thus a virtual light source is generated at the position of the outer surface of the light-radiating element 130. This virtual light source has the radiation characteristic of one or more fluorescent tubes. Individual LED illuminants are no longer discernible. Advantageously, the light-radiating element 130 is produced from diffuse plastics material.

The light-radiating element 130 in this connection is a profiled body with a substantially trapezoidal cross section. It is aligned in this case along the replaced fluorescent tube 150 and thus along the LED illuminant 110. The light-radiating element 130 then extends over the whole length of the LED illuminants 110. The limiting faces or outer surface 160 of the light-radiating element 130 in sections 165 correspond substantially with a surface form of one or more fluorescent tubes 150 that can be arranged between the carrier element 120 and the light-radiating element 130, as best shown in FIG. 2.

The reflector 30 projects into the region of the light-radiating element 130. In other words, the reflector 30 and the light-radiating element 130 overlap in part. The reflector 30 has a first light-radiation characteristic outside the light-radiating element 130. In the region inside the light-radiating element 130, the reflector has a second light-radiation characteristic. As a result, the whole light-radiation characteristic of the luminaire 10 can be adjusted further.

Advantageously, moreover, the surface of the carrier element 120 that is directed in the direction of the light-radiation is provided with a coating of high reflectivity. A further increase in the degree of efficiency of the luminaire can thus be attained.

The luminaire 10 is provided, furthermore, with a light-exit opening. The light-exit opening is in this case advantageously provided with a cover 40 which is shown in FIG. 1. The cover 40 is divided into a plurality of sections. In the vicinity of the light-radiating element 130 the cover is provided with a first light-radiation characteristic 42. In the region close to the edge of the luminaire 10, that is, remote from the light-radiating element 130, the cover 40 is provided with a second light-radiation characteristic 44. Thus further fine adjustment of the light quality can be effected in the various regions that are to be illuminated. For example, diffuse, very uniform illumination is possible in the region of the light-radiating element 130 directly in the direction of the light-exit opening of the luminaire, whilst in the lateral region, that is, to the side of the direct direction of radiation, illumination that is less diffuse is achieved with at the same time a higher degree of efficiency on account of lower losses as a result of the diffuser.

The invention is not limited to the exemplary embodiment shown. Profiles of the light-radiating element that deviate therefrom are also conceivable. Use without a reflector is within the inventive idea. All of the features described above or features shown in the figures can be combined with each other advantageously in any way within the scope of the invention.

The invention claimed is:

1. A luminaire (10) having
a housing (20),
a light-exit opening, fixed by the housing (20),
a reflector (30), and
an arrangement for light-emission having
a plurality of LED illuminants (110) in an elongate arrangement,
a carrier element (120), which carries the plurality of LED illuminants,
a light-radiating element (130) connected to the carrier element, wherein the light-radiating element (130) covers the plurality of LED illuminants (110) and has a trapezoidal cross-sectional shape with two curved sections (165) located proximate a bottom of the light-radiating element (130) and each curved section (165) forms a corner of the trapezoidal shape, and wherein said bottom has a linear profile,
wherein the two curved sections (165) are capable of diffusing light emitted from the plurality of illuminants and which correspond to the contour of two side-by-side fluorescent lights, and
wherein the plurality of LED illuminants (110) arranged in the elongated arrangement and the light-radiating element simulate light characteristics of the two side-by-side fluorescent lights, wherein the luminaire (10) has a cover of the light-exit opening arranged downstream of the light-radiating element (130) in the optical path, in that the cover has a central region close to the light-radiating element (130), in that the cover has a lateral region further away from the light-radiating element (130), and in that the cover has different light-radiation characteristics in the lateral region and in the central region, wherein the central region has a first light diffusion characteristic and the lateral region has a second light diffusion characteristic different than the first light diffusion characteristic.

2. The luminaire according to claim 1, characterised in that the light-radiating element (130) is formed as a diffuser.

3. The luminaire according to claim 1, characterised in that the carrier element (120) and the light-radiating element (130) are connected in a reversibly releasable manner, and in that the carrier element (120) and the light-radiating element (130) are connectable and releasable without a tool.

4. The luminaire according to claim 1, characterised in that the reflector (30) is connected directly to the housing (20) or completes a wall of the housing (20).

5. The luminaire according to claim 1, characterised in that the carrier element (120) is reflective in the region of the light-radiating element (130), in that the reflector (30) borders directly on the carrier element (120), in that the reflector (30) is connected to the carrier element (120), and in that the reflector (30) and the carrier element (120) are reversibly connectable and releasable without a tool.

6. The luminaire according to claim 1, characterised in that at least a first portion of the reflector (30) is arranged between the carrier element (120) and the light-radiating element (130), in that at least a second portion of the reflector (30) is not arranged between the carrier element (120) and the light-radiating element (130), and in that the first portion of the reflector (30) and the second portion of the reflector (30) have different radiation characteristics.

7. The luminaire of claim 1, wherein the second light diffusion characteristic is less diffusive than the first light diffusion property.

* * * * *